United States Patent [19]

Gravely

[11] 4,327,523

[45] May 4, 1982

[54] EMERGENCY EGRESS CASEMENT WINDOW

[75] Inventor: Edward J. Gravely, Charlotte, N.C.

[73] Assignee: Universal Window Corporation, Charlotte, N.C.

[21] Appl. No.: 4,038

[22] Filed: Jan. 17, 1979

[51] Int. Cl.[3] ..... E05C 15/02

[52] U.S. Cl. ..... 49/141; 49/365; 160/92

[58] Field of Search ..... 49/141, 365, 342, 341; 160/89, 92

[56] References Cited

U.S. PATENT DOCUMENTS

| | | | |
|---|---|---|---|
| 2,188,050 | 1/1940 | Kuyper | 49/342 X |
| 2,820,994 | 1/1958 | Metzger | 49/342 X |
| 2,920,358 | 1/1960 | Woodard | 49/365 |
| 3,000,062 | 9/1961 | McCandless | 49/365 X |

FOREIGN PATENT DOCUMENTS

| | | | |
|---|---|---|---|
| 7804 | of 1901 | United Kingdom | 49/365 |

*Primary Examiner*—Philip C. Kannan

*Attorney, Agent, or Firm*—Richards, Shefte & Pinckney

[57] ABSTRACT

An improvement in casement windows provides a mullion portion which is removable to allow for emergency egress through the window, a pivotably disengagable connection being formed between one end of the mullion portion and the head jamb of the window frame, and a tongue and groove connection being formed between downwardly and outwardly inclined complementary surfaces on the other end of the mullion portion and the sill of the window frame that allows the mullion portion to slide outwardly from a position seated in the frame to effect separation of the mullion portion from the frame simply upon opening of a sliding latch.

15 Claims, 8 Drawing Figures

EMERGENCY EGRESS CASEMENT WINDOW

BACKGROUND OF THE INVENTION

The present invention relates to casement windows, and more particularly to the provision in a casement window of a removable mullion portion to allow emergency egress through the window upon removal of the mullion portion.

Casement windows have long been a standard type of window unit used in all types of residential construction. However, recent revisions in the Minimum Property Standards promulgated by the United States Department of Housing and Urban Development relating to acceptable window opening sizes for permitting emergency egress therethrough have rendered most standard or commonly used sizes of casement windows unacceptable for use in rooms used for sleeping. According to these Standards, each sleeping room, unless it has two doors providing separate means of escape, or has a door leading outside of the building directly, must have at least one outside window which can be opened from the inside without the use of tools. Furthermore, such outside windows, must provide certain minimum net clear opening dimensions measured between the sash members of the casement window in their fully opened position and other frame members of the casement window. Since the framework of most commonly used casement windows includes a fixed center mullion with two sash members pivotably mounted in the frame on opposite sides of the mullion, a number of standard sized casement windows do not provide a sufficient net clear opening dimension between the opened sashes and the center mullion to meet the required minimum standards. As a result, it has become necessary for designers and builders of all types of residential structures to utilize awkward sizes of casement windows or different styles of windows than those which have heretofore been commonly used.

In contrast to these conventional casement windows and in response to the above-mentioned requirements of the Department of Housing and Urban Development, the present invention provides a casement window having a mullion portion which may be easily separated from the window frame from the inwardly facing side of the casement window thereby providing for removal of the mullion portion as an obstacle to emergency egress through the window. Casement windows of conventional sizes and shapes may therefore be constructed according to the present invention and utilized in residential construction in full compliance with the above-mentioned regulations.

SUMMARY OF THE INVENTION

The present invention provides an improvement in casement windows of the type having a frame with a mullion portion and at least two sash pivotably mounted in the frame on opposite sides of the mullion portion for outward pivotal opening movement. First means are provided for disengagably connecting one end of the mullion portion to the frame and second means are provided for disengagably connecting the other end of the mullion portion to the frame. The first and second connecting means provide inward seating of the mullion portion in the frame for closure of the sash with respect thereto while being yieldable in response to an outwardly directed force to permit outward separation of the mullion portion from the frame in response to an outwardly directed force being applied to the mullion. In this manner, the mullion portion may be removed from the frame as an obstacle to emergency egress through the window.

The first connecting means preferably includes at least one connecting member extending from the top of the frame and penetrating the upper end of the mullion portion to a sufficient extent to fixedly hold the mullion portion in engagement with the top of the frame against lateral movement of the mullion portion thereat, while permitting outward pivotal movement thereabout in effecting separation of the mullion portion from the frame. Therefore, in the preferred embodiment the connecting member is a nail or spike driven through the frame and to a limited extent into the mullion portion, the nail or spike being of a length and thickness sufficient to permit pivoting of the mullion portion outwardly thereabout without significant distortion thereof.

It is also preferred that the frame include a projecting mullion base fixed in the frame with the second connecting means including complementary surfaces on the mullion portion and the projecting mullion base, the complementary surfaces being inclined outwardly to facilitate outward separation of the mullion portion from the projecting mullion base and to provide wedging of the mullion portion inwardly against the projecting mullion base. The complementary surfaces preferably include a tongue and groove connection between the mullion portion and the projecting mullion base that prevents sidewise movement of the mullion portion within the frame while allowing the tongue to slide in the groove for separating movement of the mullion portion from the frame in response to the application of an outwardly directed force to the mullion portion.

In accordance with another feature of the invention, at least two window screens are held within the frame on opposite sides of the mullion portion with screen retaining means being disposed on the mullion portion and on the frame for holding the screens in the frame when the mullion portion is seated in the frame and for effecting outward separation of the screens from the frame upon outward separation of the mullion portion from the frame. This screen retaining means includes flange means disposed on the mullion portion and on the frame, with the mullion portion flange means including flanges disposed outwardly of the screens and the frame flange means including flanges disposed on the frame opposite the mullion portion and outwardly of the screens and flanges disposed on the frame adjacent the mullion portion and inwardly of the screens. Clip means are disposed on the mullion portion and on the frame inwardly of the screens for holding the screens in abutment with the flanges. Thus, upon outward separation of the mullion portion from the frame, the mullion portion clip means pulls the window screens outwardly with the mullion portion, the outward movement of the window screens being substantially unobstructed by the outwardly disposed flanges of the frame.

According to another feature of the present invention, latch means engagable between the mullion portion and the frame are provided for latching the mullion portion against outward movement when the mullion portion is seated in the frame, the latch means being disengagable to permit outward separation of the mullion portion from the frame. In the preferred embodiment, this latch means is in the form of a sliding latch member slidable in a slideway extending between the mullion portion and a projecting mullion base fixed to the frame.

DESCRIPTION OF THE PREFERRED EMBODIMENT

Referring now in greater detail to the accompanying drawings, a casement window constructed according to the preferred embodiment of the present invention is illustrated. As is readily apparent from FIG. 1, the casement window illustrated is of the type having a frame 10 constructed of wood with a single vertically disposed center mullion 12 and two sash 14 pivotably mounted in the frame 10 on opposite sides of the center mullion 12 for outward pivotal opening movement. It should be understood, however, that the invention described and illustrated herein is not limited to the specific embodiment so described and illustrated but may be applied successfully in casement windows constructed according to different designs and of different materials.

Figure 1:
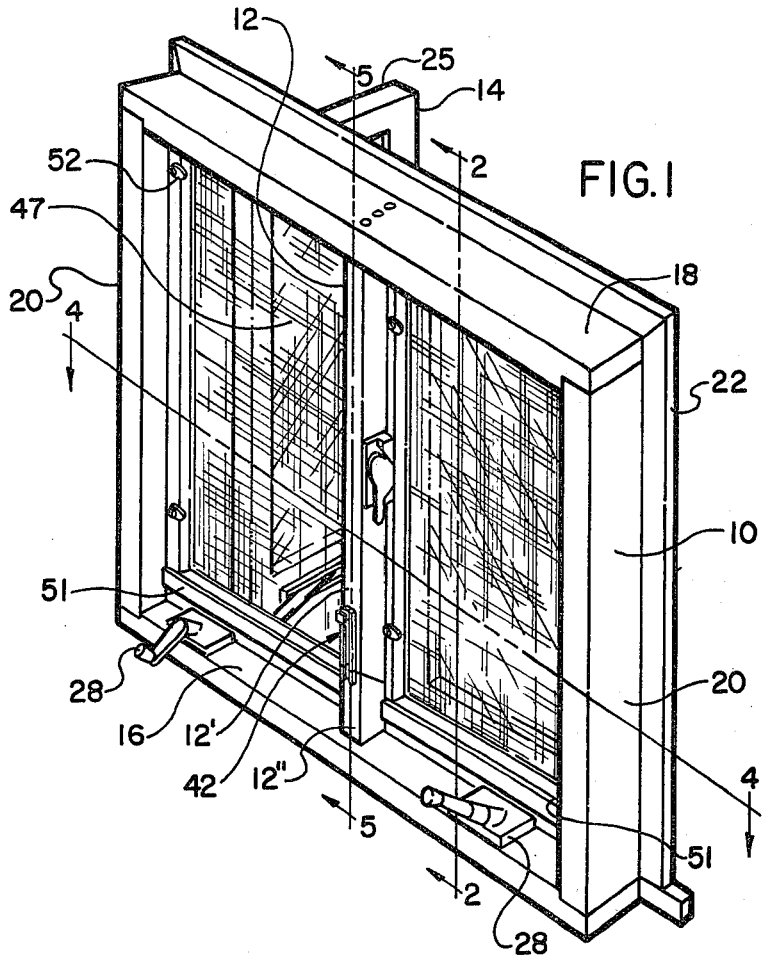
FIG. 1 is a perspective view of a casement window constructed according to the preferred embodiments of the present invention, taken from the inwardly facing side of the window.
Figure 4:
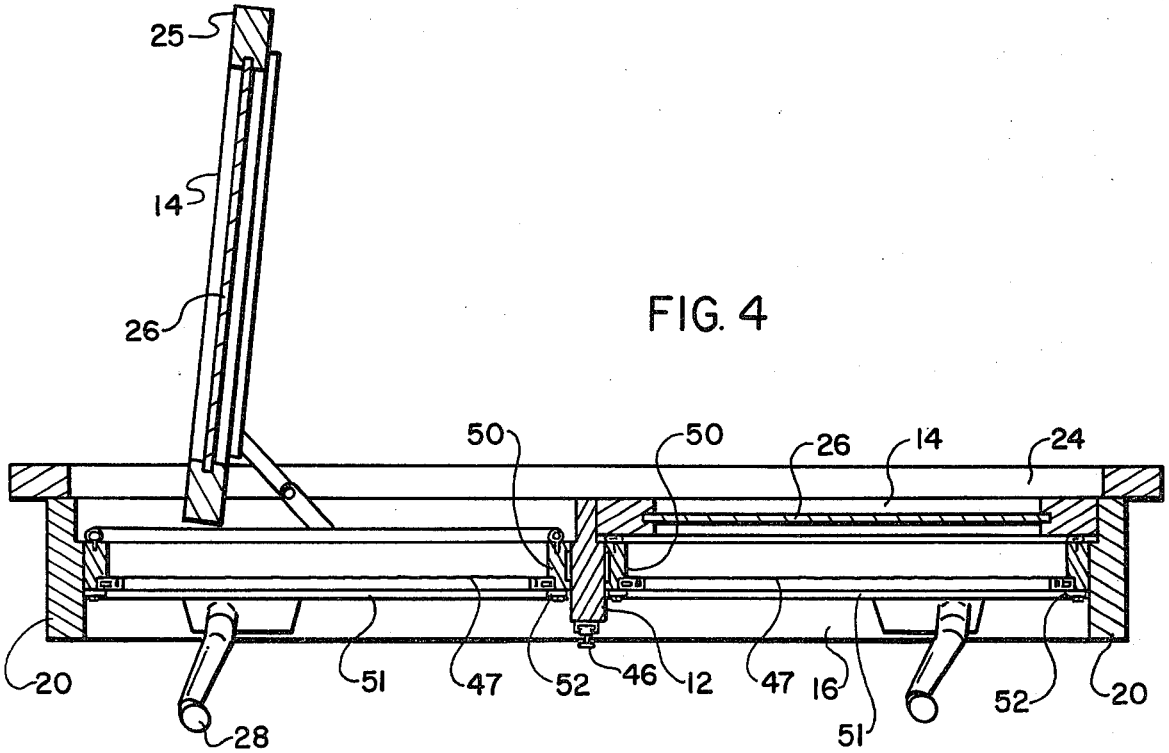
FIG. 4 is a horizontal sectional view of the casement window of FIG. 1 taken along line 4—4 of FIG. 1, with one sash opened and one sash closed.
Figure 2:
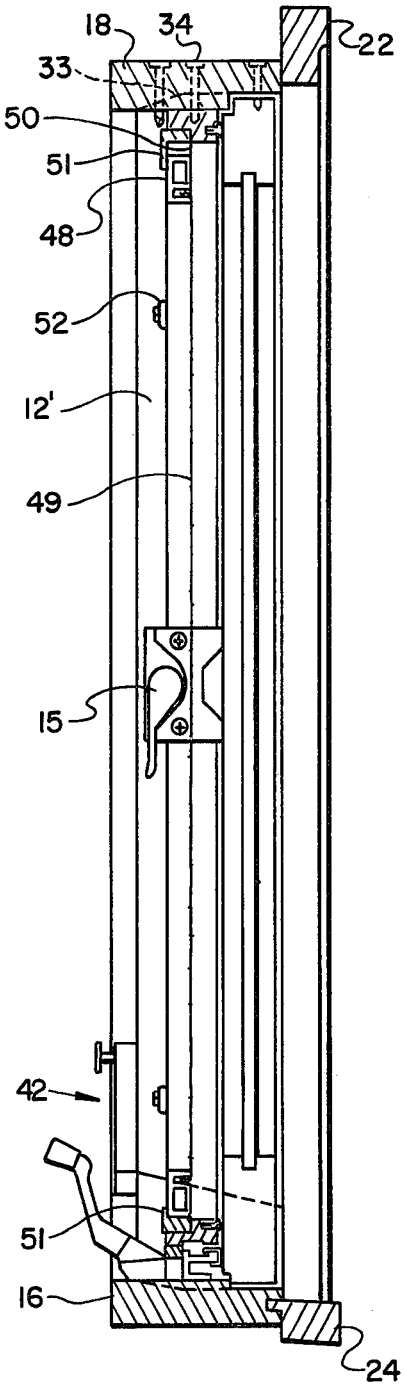
FIG. 2 is a vertical sectional view of the casement window of FIG. 1 taken along line 2—2 of FIG. 1 with both sash closed.

As can be seen in FIG. 1, frame 10 of the casement window illustrated includes a horizontally disposed sill 16, a horizontally disposed head jamb 18 spaced upwardly therefrom, and two spaced vertically disposed side jambs 20 extending transversely between the sill 16 and the head jamb 18. Extending upwardly from the head jamb 18 and outwardly from the side jambs 20 is an exterior casing 22. Similarly, a sub sill 24 extends outwardly from the sill 16. Upon installation, the head jamb 18, the side jambs 20, and the sill 16 abut the surrounding portions of the wall in which the casement window is mounted so that the casement window may be secured in place in the wall with the exterior casing 22 and the sub sill 24 resting flush against the exterior wall surface.

Two sash 14, each including a sash frame 25 and glass pane 26, are independently pivotably mounted in a conventional manner in the frame 10 on opposite sides of the mullion 12 and a roto operator 28 also of conventional design, is provided for each sash 14 to allow selective outward pivotal opening movement of the two sash 14. Sash locks 15 are provided for locking the sash, when closed, against opening movement.

The center mullion 12 extends vertically from the sill 16 to the head jamb 18 intermediately of the side jambs 20 and comprises a removable mullion portion 12' and a projecting mullion base 12'', the projecting mullion base 12'' being rigidly affixed to the sill 16 of the frame 10 and extending upwardly therefrom. Means are provided for disengagably connecting the mullion portion 12' at the upper end 30 thereof to the head jamb 18 and at the lower end 32 thereof to the projecting mullion base 12'', the respective disengagable connecting means providing for inward seating of the mullion portion 12' in the frame 10 while being yieldable in response to an outwardly directed force to permit outward separation of the mullion portion 12' from the frame 10.

In the preferred embodiment, the upper end 30 of the mullion portion 12' is tapered slightly downward toward the inward facing side of the window frame and a correspondingly tapered slot 33 is provided in the head jamb 18 to receive the tapered upper end 30 of the mullion portion 12'. The means for disengagably connecting the upper end 30 of the mullion portion 12' to the head jamb 18 includes, in the preferred embodiment, three case hardened nails 34 driven through the head jamb 18 and into the upper end 30 of the mullion portion 12' to fixedly hold the upper end 30 of the mullion portion 12' in engagement with the head jamb 18 against lateral movement of the mullion portion 12' thereat while permitting outward pivotal movement thereabout in effecting separation of the mullion portion 12' from the frame 10. The mullion portion 12' is therefore held in engagement with the top of the frame 10 in a manner permitting simultaneous downward and outward separation of the mullion portion 12' from the frame 10 upon outward pivotal movement of the mullion portion 12' about the nails 34.

To provide a sturdy connection while also allowing for the desired manner of disengagement of the mullion portion 12' from the head jamb 18, the nails 34 should be of a length sufficient to penetrate and extend through the head jamb 18 and also penetrate the mullion portion 12' to a sufficient extent to prevent lateral movement of the mullion portion 12' thereat but to an extent limited sufficiently so as not to prevent outward pivotal movement of the mullion portion 12' thereabout. The nails 34 should also be of a length and thickness sufficient to permit pivoting of the mullion portion 12' thereabout without significant distortion thereof so that after separation thereof the mullion portion 12' may be replaced in the frame in its initially seated and retained manner. Thus, in a preferred form of the invention the head jamb 18 is approximately $1\frac{1}{4}$ inches thick with the slot 33 being approximately $\frac{1}{4}$ inch deep at its outermost point and of decreasing depth as it tapers inwardly therefrom. The three nails 34 are suitably 3/16 inch diameter case hardened nails and the outermost nail 34' is $1\frac{1}{4}$ inches long with the two innermost nails 34'' being $1\frac{1}{2}$ inches long. In this manner, the outermost nail 34' penetrates the mullion portion 12' approximately $\frac{1}{4}$ inches while the penetration of the two innermost nails 34'' may range between $\frac{3}{8}$ to $\frac{3}{4}$ inches depending upon their location, thereby achieving the desired type of disengagable connection between the frame 10 and the upper end 30 of the mullion portion 12'.

Figure 3:
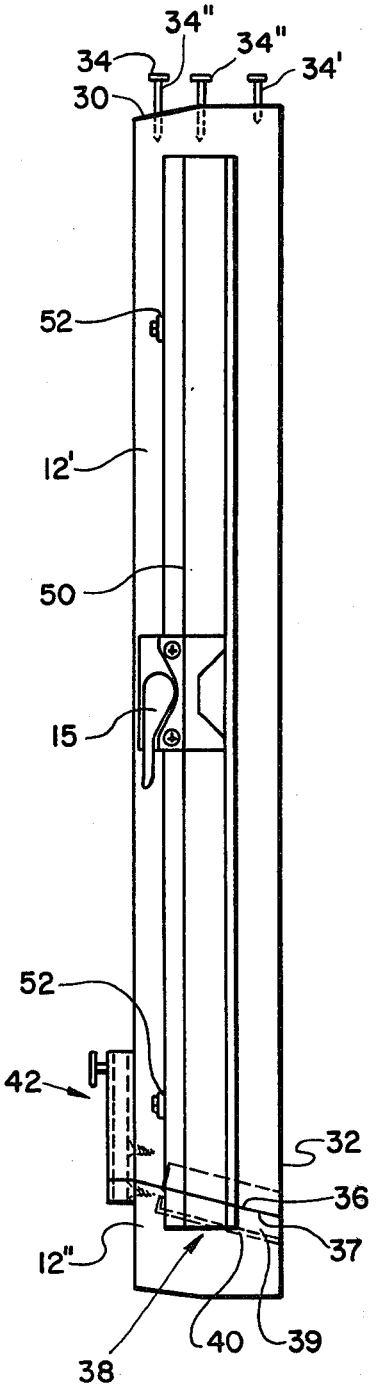
FIG. 3 is a side elevational view of the removable mullion portion and the projecting mullion base of the present invention.
Figure 5:
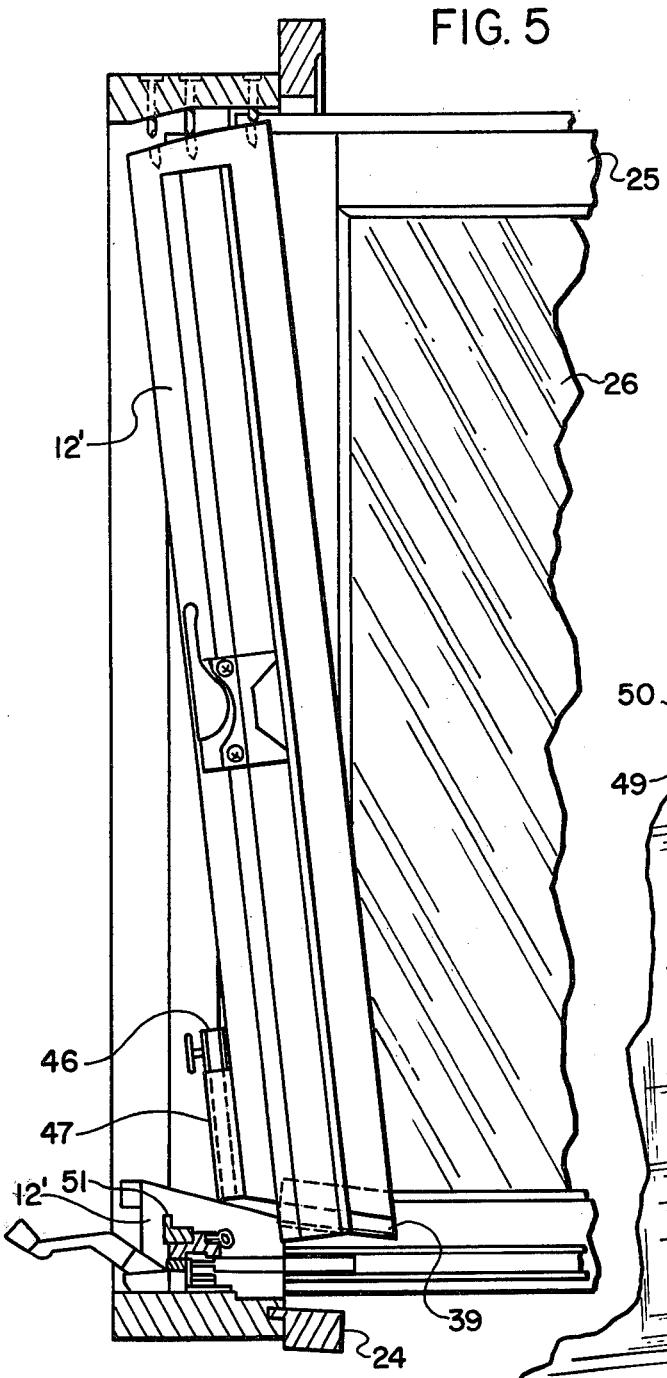
FIG. 5 is a vertical sectional view taken along line 5—5 of FIG. 1 illustrating the initial outward separation of the mullion portion from the casement window frame, the screens of FIG. 1 having been eliminated for clarity.
Figure 6:
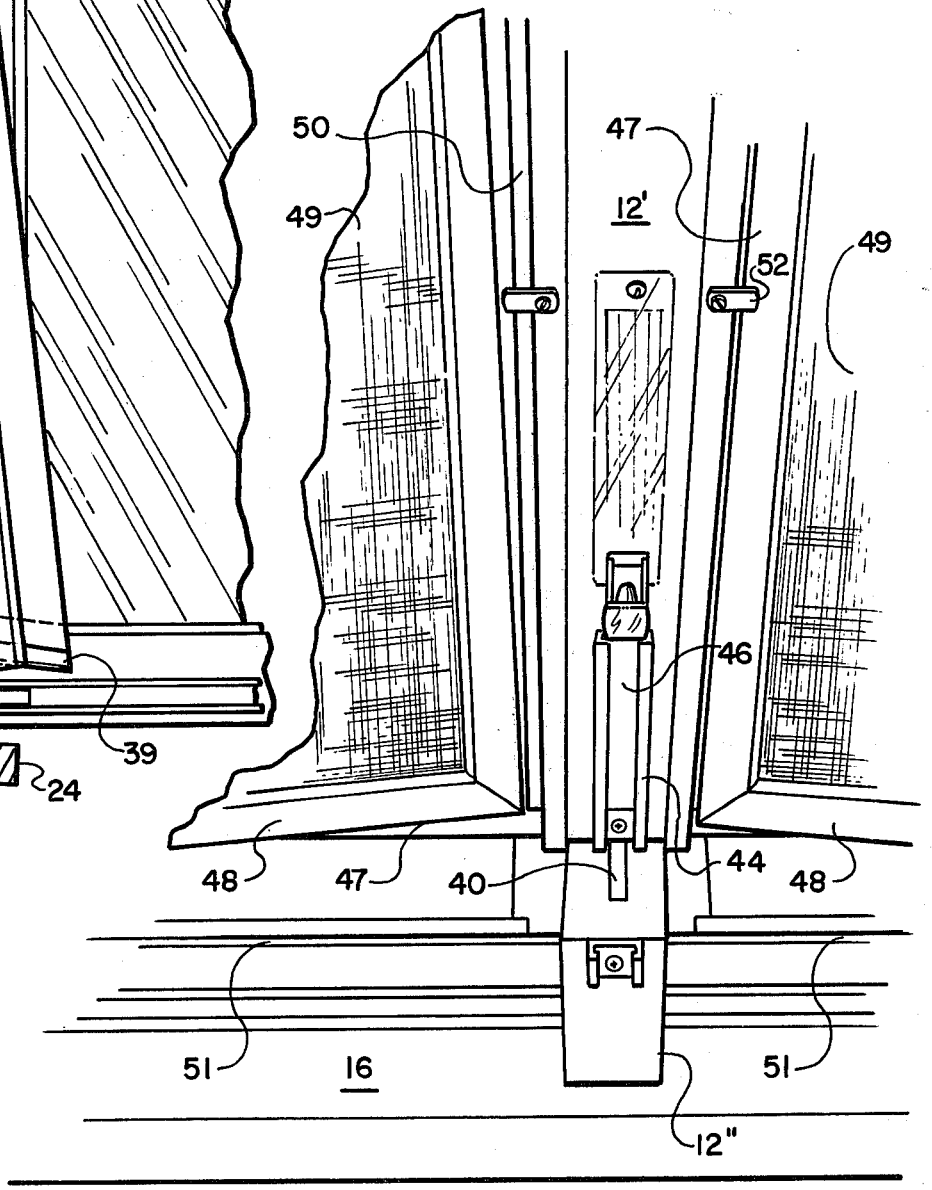
FIG. 6 is an enlarged perspective view of the complementary surfaces of the mullion portion and the projecting mullion base of the casement window frame illustrating the initial separation of the mullion portion from the projecting mullion base.

The preferred means for disengagably connecting the lower end 32 of the mullion portion 12' to the projecting mullion base 12'' is best illustrated in FIG. 3 and FIG. 6, and comprises complementary surfaces 36, 37, formed on the lower end 32 of the mullion portion 12' and on the upper facing surface of the projecting mullion base 12'', respectively. The complementary surfaces 36, 37, are inclined outwardly and are provided with a tongue and groove connection therebetween, indicated generally by reference numeral 38, the tongue 39 being formed on the complementary surface 36 of the mullion portion 12' and the groove 40 being formed in the complementary surface 37 of the projecting mullion base 12''. In this manner, outward separating movement of the mullion portion 12' from the frame 10 is facilitated, the complementary surfaces 36, 37, and the tongue and groove connection 38 allowing the tongue 39 to slide in the groove 40 in response to the application of an outwardly directed force to the mullion portion 12', while providing a wedging of the complementary surface 36 inwardly against the complementary surface 37 and of the tongue 39 in the groove 40, thereby providing a seating of the tongue 39 inwardly in the groove 40. Additionally, the tongue and groove connection 38 serves to prevent sidewise movement of the mullion portion 12'.

As seen in FIG. 1, latch means, generally indicated by reference numeral 42, is provided for latching the mullion portion 12' against outward movement thereof when the mullion portion 12' is seated in the frame 10, the latch means 42 being disengagable to permit such outward separation of the mullion portion 12' when necessary. The latch means 42 is preferably located so as to be generally inaccessible from the exterior side of the window frame when the sash 14 are closed so that casement windows constructed according to the present invention are no more easily broken and entered than are conventional casement windows. As best seen in FIG. 6, the latch means 42 includes a slideway 44 disposed on and extending between the mullion portion 12' and the projecting mullion base 12'' with a sliding latch member 46 slidable in the slideway 44. Thus, be selectively moving the sliding latch member 46 in the slideway 44 between a latching position in which the latch member 46 overlaps the mullion portion 12' and the projecting mullion base 12'', as shown in FIG. 1, and an open position in which the latch member is fully retracted in the slideway 44 onto the mullion portion 12' and away from the mullion base 12'' out of its latching position, as shown in FIG. 6, outward separation may be either prevented or facilitated, respectively, as desired.

The frame 10 of the casement window of the present invention is also provided with two conventional window screens 47 each having a screen frame 48 with a sheet of mesh material 49 stretched thereacross, the screens 47 being held within the frame 10 on opposite sides of the mullion portion 12' by flanges 50, 51, and clips 52 disposed on both the mullion portion 12' and on the frame 10. The flanges 50, 51, and clips 52 serve a two-fold purpose of holding the screens 47 in the frame 10 when the mullion portion 12' is seated in the frame 10 and effecting outward separation of the screens 47 from the frame 10 upon outward separation of the mullion portion 12'. The flanges 50 are disposed outwardly of the screens 47 on opposite sides of the mullion portion 12' and on the side jambs 20 of the frame 10 opposite the mullion portion 12', while the flanges 51 are disposed inwardly of the screens 47 adjacent the mullion portion 12' on the head jamb 18 and on the sill 16 of the frame 10. Clips 52 are disposed inwardly of the screens 47 on both the mullion portion 12' and on the side jambs 20 of the frame 10 for holding the screens 47 in abutment with the flanges 50, 51.

Figure 7:
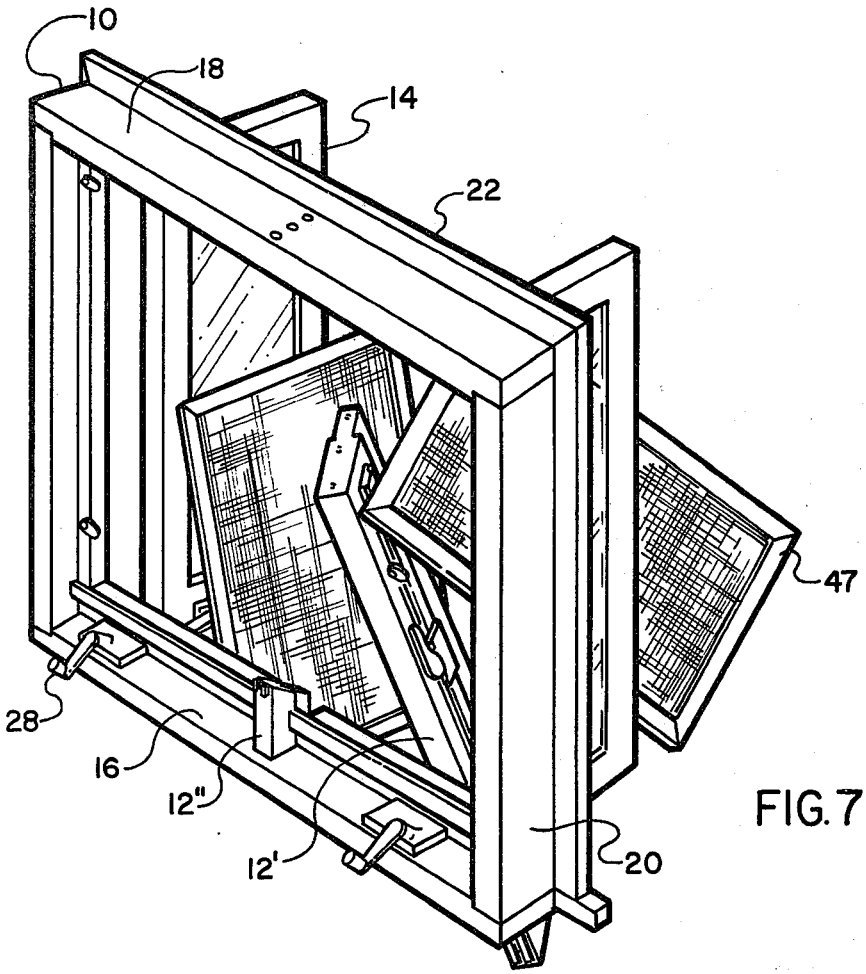
FIG. 7 is a perspective view of the casement window of FIG. 1 illustrating the final separation of the mullion portion from the casement window frame.
Figure 8:
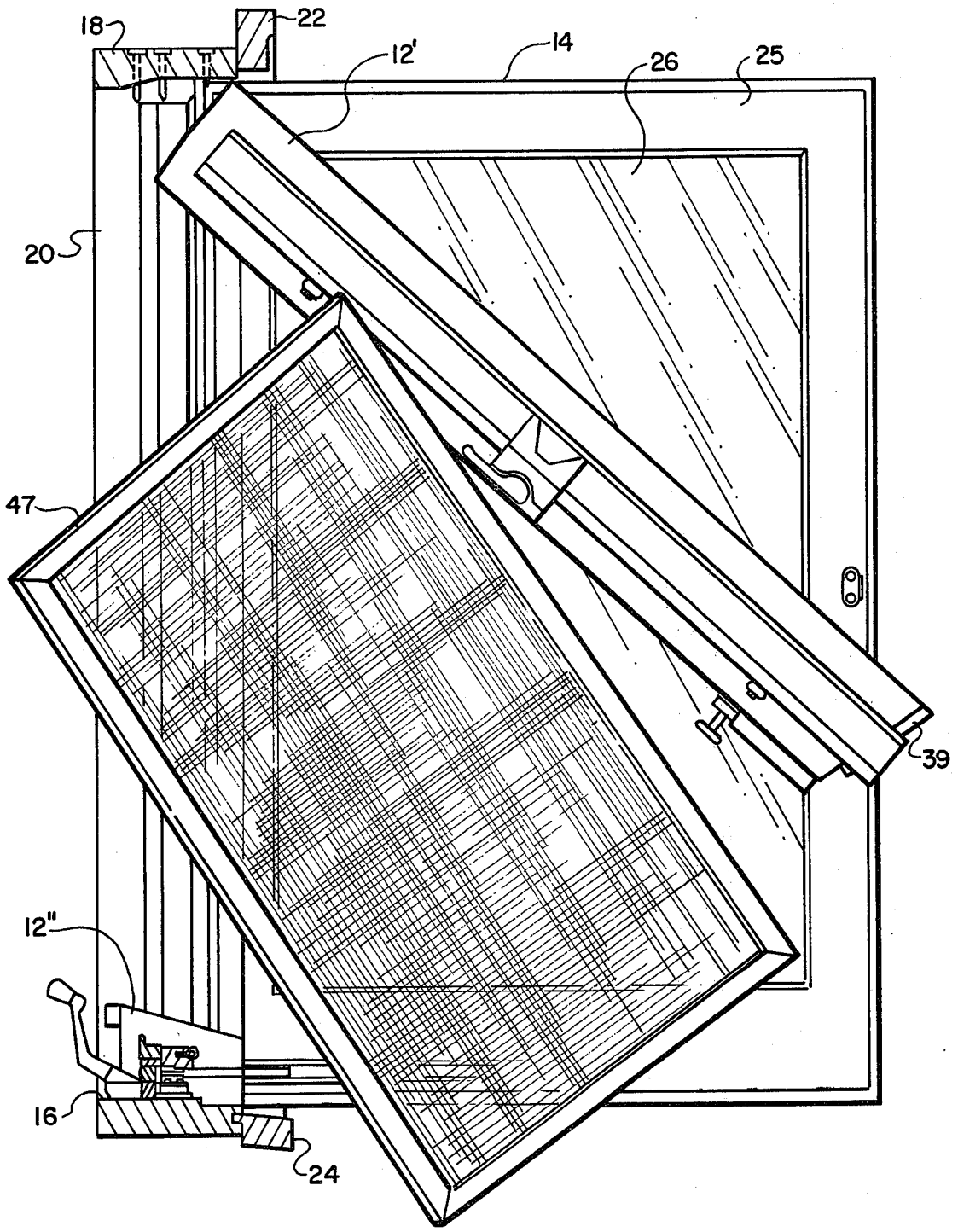
FIG. 8 is a vertical sectional view of the casement window of FIG. 1 taken along line 2—2 of FIG. 1 with both sash opened, showing the final separation of the mullion portion from the casement window frame.

When it is desired or necessary to utilize the casement window to obtain emergency egress from the building in which it is installed, egress therethrough may be quickly and easily accomplished by initially operating the roto operators 28 to open both sash 14 to their fully opened positions, disengaging the latch means 42 by retracting the sliding latch member 46 in the slideway 44 to its open position so as not to extend between the mullion portion 12' and the projecting mullion base 12'', and exerting an outwardly directed force against the mullion portion 12' adjacent the lower end 32 thereof. The complementary surface 36 will slide outwardly along the complementary surface 37 as the tongue 39 slides outwardly in groove 40, as illustrated in FIG. 6. As separation of the lower end 32 of the mullion portion 12' from the projecting mullion base 12'' is thus effected, separation of the upper end 30 of the mullion portion 12' from the head jamb 18 begins, the mullion portion 12' pivoting outwardly about the three nails 34, as shown in FIG. 7. Additionally, since the flanges 50, 51, and the clips 52 of the mullion portion 12' hold the screens 47 therebetween and since the outwardly disposed flanges 50 of the frame 10 are located on the side jambs 20, the clips 52 of the mullion portion 12' pull the screens 47 outwardly with the mullion portion 12', the outward movement of the screens 47 being generally unobstructed by either the outwardly disposed flanges 50 or the clips 52 of the frame 10.

The performance of the above-described operation produces an open space for egress of a size more than sufficient to comply with the standards of the Department of Housing and Urban Development hereinbefore mentioned. For example, in a typical conventional casement window having a single center mullion and two sash mounted in the frame on opposite sides of the mullion, each sash having a sash frame width of 18 inches, the horizontal or width dimension between the mullion and the sash when fully opened is only 12 inches, whereas, when the same casement window is equipped with a removable mullion portion according to the present invention, the width between the two sash after removal of the mullion is 30 inches, assuming of course that the width of the center mullion portion 12 measures approximately 6 inches. It can therefore be seen that the construction of casement windows in accordance with the present invention enables designers and builders of residential structures to fully comply with all prevailing guidelines of the Department of Housing and Urban Development without having to sacrifice aesthetics by utilizing odd or awkward sizes of casement windows or utilizing other less attractive types of windows.

Although the present invention has been described in relation to the preferred embodiments, it is to be understood that modifications and variations may be resorted to without departing from the substance or scope of the present invention as those skilled in the art will readily understand. Such modifications and variations are within the scope of the present invention which is intended to be limited only by the appended claims and equivalents thereof.

I claim:

1. In a casement window of the type having a frame with a mullion portion and at least two sash pivotably mounted in said frame on opposite sides of said mullion portion for outward pivotal opening movement, the improvement comprising mullion base means fixed in said frame, first means for disengagably connecting one end of said mullion portion to said frame opposite said mullion base means, and second means for disengagably connecting the other end of said mullion portion to said mullion base means, said second connecting means including outwardly inclined complementary surfaces on said other end of said mullion portion and said mullion base means, said first and second connecting means providing for inward seating of said mullion portion in said frame including inward wedging of said other end of said mullion portion in said frame at said mullion base means thereof for ordinary opening and closure operation of said sash with respect to said mullion portion while being yieldable in response to a force directed outwardly against said other end of said mullion portion adjacent said complementary surfaces of said second connecting means to permit outward separation and ejection of said mullion portion from said frame, thereby permitting removal of said mullion portion from said frame as an obstacle to emergency egress through the window.

2. A casement window according to claim 1 and characterized further by latch means engagable between said mullion portion and said frame for disengagably latching said mullion portion against outward movement when said mullion portion is seated in said frame.

3. A casement window according to claim 2 and characterized further in that said latch means is disposed at a location generally inaccessible from the exterior of the frame when the sash are closed.

4. A casement window according to claim 3 and characterized further in that said latch means includes a slideway and a sliding latch member slidable in said slideway, said slideway being disposed on and extending between said other end of said mullion portion and said mullion base means of said frame for selected movement of said latch member between a latching position, overlapping both said other end of said mullion portion and said mullion base means of said frame to prevent outward separation of said mullion portion from said frame, and an open position wherein said latch member is out of said latching position to permit said outward separation of said mullion portion.

5. A casement window according to claim 4 and characterized further in that said mullion base means of said frame includes a projecting mullion base fixed in said frame, said other end of said mullion portion being connected thereto by said second connecting means, and said slideway extending between said mullion portion and said projecting mullion base.

6. A casement window according to claim 1 and characterized further in that said first connecting means includes at least one connecting member for engaging said frame and said one end of said mullion portion to fixedly hold said one end of said mullion portion in engagement with said frame against lateral movement of said mullion portion thereat while permitting outward pivotal movement thereabout in effecting separation of said mullion portion from the frame.

7. A casement window according to claim 6 and characterized further in that said at least one connecting member fixedly holds said one end of said mullion portion in engagement with the top of the frame in a manner permitting simultaneous downward and outward separation of said mullion portion from the top of the frame upon outward pivotal movement of said mullion portion thereabout.

8. A casement window according to claim 6 and characterized further in that said at least one connecting member extends from said frame and penetrates said one end of said mullion portion to a sufficient extent to prevent lateral movement of said mullion portion thereat but insufficiently to prevent outward pivotal movement of said mullion portion thereabout.

9. A casement window according to claim 8 and characterized further in that said at least one connecting member is of a length and thickness sufficient to permit pivoting of said mullion portion outwardly thereabout without significant distortion thereof.

10. A casement window according to claim 9 and characterized further in that said at least one connecting member is a nail or spike driven through said frame and to a limited extent into said mullion.

11. A casement window according to claim 1 and characterized further in that said complementary surfaces include a tongue and groove connection between said mullion portion and said mullion base means of said frame that prevents sidewise movement of said mullion portion within said frame while allowing said tongue to slide in said groove for separating movement of said mullion portion from said frame in response to an outwardly directed force being applied to said mullion portion.

12. A casement window according to claim 1 and characterized further in that said mullion base means of said frame includes a projecting mullion base, said complementary surfaces being on said mullion portion and said projecting mullion base.

13. A casement window according to claim 1 and characterized further by at least two window screens held within the frame on opposite sides of said mullion portion and by screen retaining and ejecting means disposed on said mullion portion and on said frame for holding said screens in said frame when said mullion portion is seated in said frame and for automatically effecting outward separation of said screens from said frame upon outward separation of said mullion portion from said frame.

14. A casement window according to claim 13 and characterized further in that said screen retaining means includes flange means disposed on said mullion portion and on said frame and clip means disposed on said mullion portion and on said frame inwardly of said screens for holding said screens in abutment with said flange means.

15. A casement window according to claim 14 and characterized further in that said mullion portion flange means includes flanges disposed outwardly of said screens, and in that said frame flange means includes flanges disposed on said frame opposite said mullion portion and outwardly of said screens, and flanges disposed on said frame adjacent said mullion portion and inwardly of said screens, whereby, upon outward separation of said mullion portion from the frame, said mullion portion clip means pulls said window screens outwardly with said mullion portion, the outward movement of said window screens being substantially unobstructed by said outwardly disposed flanges of said frame.

* * * * *